US006640079B2

(12) United States Patent
Lim et al.

(10) Patent No.: US 6,640,079 B2
(45) Date of Patent: Oct. 28, 2003

(54) ENGAGE/DISENGAGE APPARATUS AND PHOTOSENSITIVE MEDIUM CLEANING DEVICE OF LIQUID PRINTER USING THE SAME

(75) Inventors: Kwang-taek Lim, Kwangmyoung (KR); Jin-soo Lee, Suwon (KR)

(73) Assignee: Samsung Electronics Co., Ltd., Kyungki-Do (KR)

( * ) Notice: Subject to any disclaimer, the term of this patent is extended or adjusted under 35 U.S.C. 154(b) by 0 days.

(21) Appl. No.: 10/028,728

(22) Filed: Dec. 28, 2001

(65) Prior Publication Data

US 2002/0118988 A1 Aug. 29, 2002

(30) Foreign Application Priority Data

Feb. 26, 2001 (KR) ..... 2001-9572

(51) Int. Cl.[7] ..... G03G 21/00
(52) U.S. Cl. ..... 399/345; 399/357
(58) Field of Search ..... 399/343, 345, 399/346, 348, 357; 15/1.51

(56) References Cited

U.S. PATENT DOCUMENTS 4,165,172 A * 8/1979 Okamoto et al. ..... 399/348
4,344,361 A * 8/1982 MacPhee et al. ..... 399/346 X
4,465,363 A * 8/1984 Schmitt et al. ..... 399/348
4,890,135 A * 12/1989 Gardiner et al. ..... 399/348
5,596,398 A * 1/1997 Woo et al. ..... 399/346
5,911,101 A * 6/1999 Park ..... 399/345
6,035,176 A * 3/2000 Byeon ..... 399/345

* cited by examiner

*Primary Examiner*—Sandra Brase
(74) *Attorney, Agent, or Firm*—Sughrue Mion, PLLC

(57) ABSTRACT

A device for engaging and disengaging an object in one direction and a photosensitive medium cleaning device of a liquid printer using the same are provided. The device for engaging and disengaging includes a housing, a driving motor disposed at the housing, a rotating bracket, rotatably disposed at the housing, for supporting the object, and a cam unit, capable of rotating and moving linearly by a rotating force of the driving motor, for transferring the rotating bracket to one side by being rotated after being moved linearly to the rotating bracket while the driving unit is rotating in one direction, the cam unit being separated from the rotating bracket enabling the rotating bracket to return to an initial position while the driving motor is rotating reversely.

13 Claims, 8 Drawing Sheets

ENGAGE/DISENGAGE APPARATUS AND PHOTOSENSITIVE MEDIUM CLEANING DEVICE OF LIQUID PRINTER USING THE SAME

BACKGROUND OF THE INVENTION

1. Field of the Invention

The present invention relates to engage and disengage means and a photosensitive medium cleaning device of a liquid printer eliminating remaining filth in the photosensitive medium by contacting a cleaning roller with the photosensitive medium and separating the cleaning roller from the photosensitive medium using the engage and disengage means. The present invention is based on Korean Patent Application No. 2001-9572, which is incorporated herein by reference.

2. Description of the Related Art

Generally, printers such as a laser printer and a photocopying machine, are divided into two groups according to their developing method: one employing a dry method using powder toner and the other employing the wet method using blended liquid toner hydrocarbon solvents like NORPAR. The two methods develop a predetermined image by supplying toner to a photosensitive medium like a photosensitive belt, on which an electrostatic latent image is formed. Then, the developed image is printed on a paper as the paper goes through a transferring medium by contacting with the photosensitive belt. Recently, the wet method is widely applied.

FIG. 1 is a schematic block diagram showing a conventional printer employing a wet developing method.

As shown in FIG. 1, a printer employing a wet developing method includes: a photosensitive belt 10 supported by a supporting roller 11*a*, steering roller 11*b*, and a driving roller 11*c*; a plurality of laser scanning units (LSU) 13 for forming an electrostatic latent image on the photosensitive belt 10; a plurality of developing devices 14 for supplying a developing device with mixed toner containing predetermined colors and carrier on the electrostatic latent image formed on the photosensitive belt 10 and developing a predetermined image; a drying unit 15 for drying carrier that is left on the photosensitive belt 10 after going through the developing devices 14; a transferring unit 16 for transferring the developed image on the photosensitive belt 10 to the paper P; and a cleaning device 20 for cleansing the photosensitive belt 10.

The transferring unit 16 includes a transferring roller 17 receiving an image from the photosensitive belt 10 while rotating in contact with the photosensitive belt 10, and a settling roller 18 that rotates in contact with the transferring roller. A paper is printed on while moving between the settling roller 18 and the transferring roller 17 and receiving an image transferred from the transferring roller 17.

The cleaning device 20 is formed for eliminating filth such as dust or remaining toner on the photosensitive belt 10, which has not transferred to the transferring roller 17 from the photosensitive belt 10 during a printing operation. The cleaning device 20 includes a cleaning roller 21, which contacts with the photosensitive belt 10 and rotates, and a NORPAR supplying unit 23 for supplying liquid NORPAR to the cleaning roller 21. The cleaning roller 21 is disposed for rotating in contact with the photosensitive belt 10, and the cleaning roller 21 is selectively rotated by a driving source (not shown). The NORPAR supplying unit 23 wets the cleaning roller 21 with NORPAR supplied from a NORPAR tank 24 to the cleaning roller 21. Therefore, the cleaning roller 21, wet with NORPAR, rotates in contact with the photosensitive belt, and thus removes remaining toner or filth from the photosensitive belt 10.

However, in a conventional cleaning device 20 with the above construction, the cleaning roller 21 is maintained in contact all the time with the photosensitive belt 10. Therefore, even when printing is not performed, the photosensitive belt 10 and the cleaning roller 21 are contacted with each other, and NORPAR on the cleaning roller 21 penetrates to the photosensitive belt 10. Then, the photosensitive belt 10 swells because of the penetrated NORPAR, and when printing is performed, the image is not developed as a normal one and the life span of the photosensitive belt 10 is shortened.

SUMMARY OF THE INVENTION

The present invention has been made to overcome the above-mentioned problems of the related art. Accordingly, it is an object of the present invention to provide engage and disengage means having an improved construction for engaging and disengaging an object to one side and a photosensitive medium cleaning device of a printer employing the wet method using the engage and disengage means.

To accomplish the above object, an embodiment of the present invention, including an engage and disengage means for engaging and disengaging an object to one direction, comprises: a housing; a driving motor disposed at the housing; a rotating bracket, rotatably disposed at the housing, for supporting the object; a cam unit, capable of rotating and moving straight by a rotating force of the driving motor, for transferring the rotating bracket to one side by being rotated after being moved straight to the rotating bracket while the driving unit is rotating in one direction, so that the rotating bracket can return to its initial position by being separated from the rotating bracket while the driving motor is rotating in the opposite direction.

It is preferable that the cam unit comprises: a driving shaft disposed at the housing for rotating by the driving motor; a cylinder type pipe disposed at the circumference of the driving shaft for rotating and moving straight for a predetermined length, and while the pipe is moving straight in one direction from its initial position, the front end of the pipe contacts with the rotating bracket and separates from the rotating bracket; a power transferring unit that transfers the rotating of the driving shaft to straight movement of the pipe, so that the pipe can move straight in one direction, and when the pipe is contacted with the rotating bracket, transfers the entire rotating power to the pipe for rotating; and a guide unit for guiding the rotating bracket to mount on the circumference of the pipe and rotate, while the pipe is rotating in one direction being contacted with the rotating bracket, and guiding the rotating bracket to return to its initial position, while the pipe is rotating in the opposite direction.

The photosensitive medium cleaning device of a printer employing the wet method according to the present invention, comprises: a cleaning roller for eliminating filth on the surface of the photosensitive medium by contacting with the photosensitive medium; a NORPAR supplying unit for supplying liquid NORPAR to the cleaning roller; and engage and disengage means for rotatably supporting the cleaning roller, and contacting the cleaning roller with the photosensitive medium and separating the cleaning roller from the photosensitive medium.

The photosensitive medium cleaning device of a printer employing the wet method according to the present invention, comprises: a cleaning roller for eliminating filth on the surface of the photosensitive medium by contacting with the photosensitive medium; a norpar supplying unit for supplying liquid norpar to the cleaning roller; and engage and disengage means for rotatably supporting the cleaning roller, and contacting the cleaning roller with the photosensitive medium and separating the cleaning roller from the photosensitive medium.

It is advisable that the engage and disengage means includes: a housing fixed closely to the photosensitive medium; a driving motor disposed at the housing for rotating a cleaning roller contacted with the photosensitive medium; a rotating bracket rotatably disposed at the housing for rotatably supporting the cleaning roller and contacting the cleaning roller with the photosensitive medium and separating the cleaning roller from the photosensitive medium; and a cam unit, rotating and moving straight by a rotating force of the driving motor, moves the rotating bracket for the cleaning roller to be contacted with the photosensitive medium by being rotated after being moved to the rotating bracket, while the driving motor is rotating in one direction, and returns the rotating bracket to its initial position by being separated from the rotating bracket, while the rotating motor is rotating in the opposite direction.

It is preferable that the cam unit includes: a driving shaft disposed at the housing for being rotated by the driving motor; a cylinder type pipe disposed at the circumference of the driving shaft for rotating and moving straight, and while the pipe is moving straight in one direction from its initial position, the front end of the pipe contacts with the rotating bracket; a power transferring unit for transferring the rotating of the driving shaft into straight movement of the pipe, so that the pipe can move straight in one direction, and when the pipe is contacted with the rotating bracket, transfers the rotating force to the pipe; and a guide unit for guiding the rotating bracket to mount on the circumference of the pipe when the pipe is contacted with the rotating bracket and rotate in one direction, and guiding the rotating bracket to get down form the circumference of the pipe while the pipe is rotating in the opposite direction.

It is recommended that the power transferring unit includes: a spiral guide slit formed at the pipe for a predetermined length; a guide pin fixed at the circumference of the driving shaft for guiding movement of the pipe as the guide pin relatively moves following the guide slit while the driving unit is rotating; and a friction member for supplying a friction force to the pipe. The friction member supplies a friction force to the pipe and prevents the pipe from being rotated by rotating power of the driving shaft, so that the pipe can move straight by the relative movement of the guide pin and the guide slit.

It is advisable that the guide slit, formed diagonally with an angle of more than 45 degrees to the driving shaft, guides the guide pin to relatively slide following the guide slit with less force than the friction force of the friction member.

It is preferable that the photosensitive medium cleaning device of a printer employing the wet method further includes a spring member for flexibly pressing the pipe in the direction of separating from the rotating bracket.

It is recommended that the guide unit includes a contacting member protruding from the rotating bracket to the range of straight movement of the pipe and a stopping member formed at a diagonal surface on one end side of the pipe at a predetermined angle along the direction of the circumference. While the pipe is rotating after being moved to the contacting member, the contacting member moves following the diagonal surface, is stopped by the stopping member, and mounts on the circumference of the pipe so that the cleaning roller can contact with the photosensitive medium.

It is preferable that the photosensitive medium cleaning device of a printer employing the wet method further includes a spring for supplying a flexible force for the pipe to return to its initial position when the driving shaft stops. The rotating bracket, disposed eccentrically from a rotating center, is rotated by its own weight so that the cleaning roller can be separated from the photosensitive medium when the cleaning roller, contacted with the photosensitive medium, is separated from the pipe.

It is recommended that the photosensitive medium cleaning device of a printer employing the wet method further includes a spring member for flexibly pressing the rotating bracket in the direction of the cleaning roller until separated from the photosensitive medium.

It is advisable that the NORPAR supplying unit includes: a discharging nozzle having a plurality of nozzles disposed at the rotating bracket to the opposite side of the cleaning roller for discharging NORPAR; a NORPAR tank for storing NORPAR and supplying NORPAR to the discharging nozzle; and a supplying pump for pumping the NORPAR in the NORPAR tank to the discharging nozzle through a supplying passage.

It is preferable that the cleaning roller is disposed at a predetermined place for being contacted with the photosensitive medium before an electrostatic latent image being formed thereon by a light projected from a laser projecting unit.

DETAILED DESCRIPTION OF THE PREFERRED EMBODIMENTS

Figure 1:
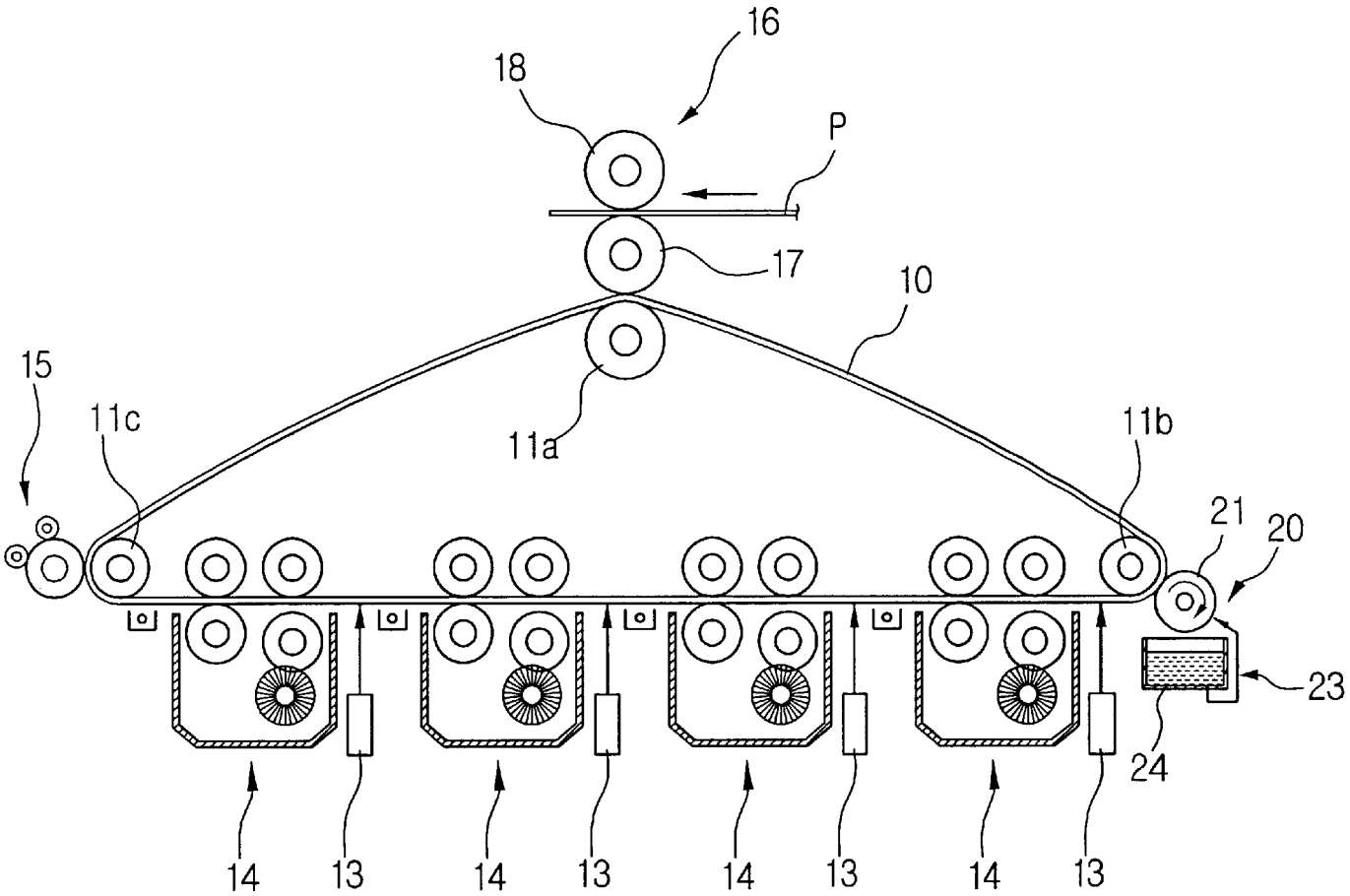
FIG. 1 (PRIOR ART)
FIG. 1 is a schematic block diagram showing a conventional printer employing the wet method.
Figure 2:
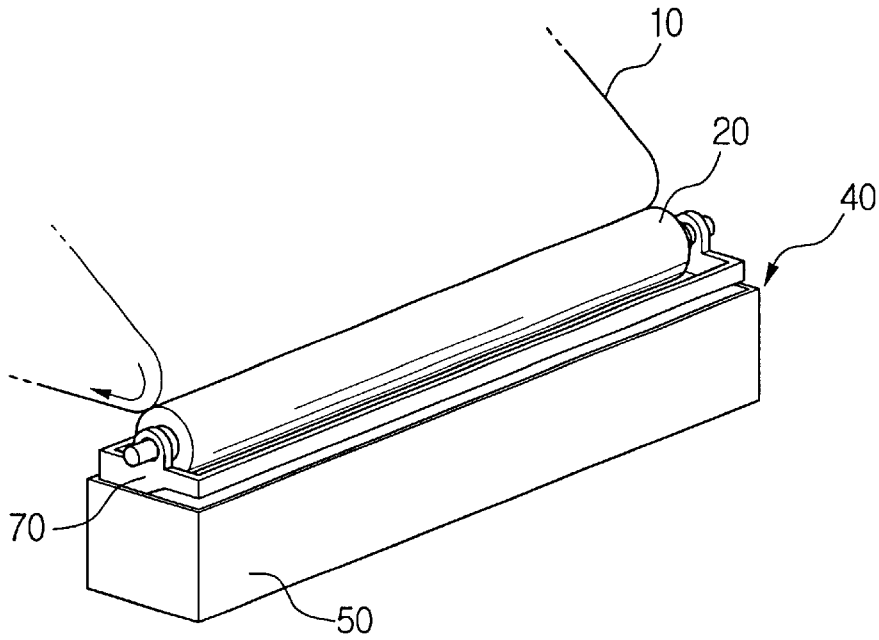
FIG. 2 is a schematic perspective view showing a photosensitive medium cleaning device of a printer employing engage and disengage means according to a preferred embodiment of the present invention.
Figure 3:
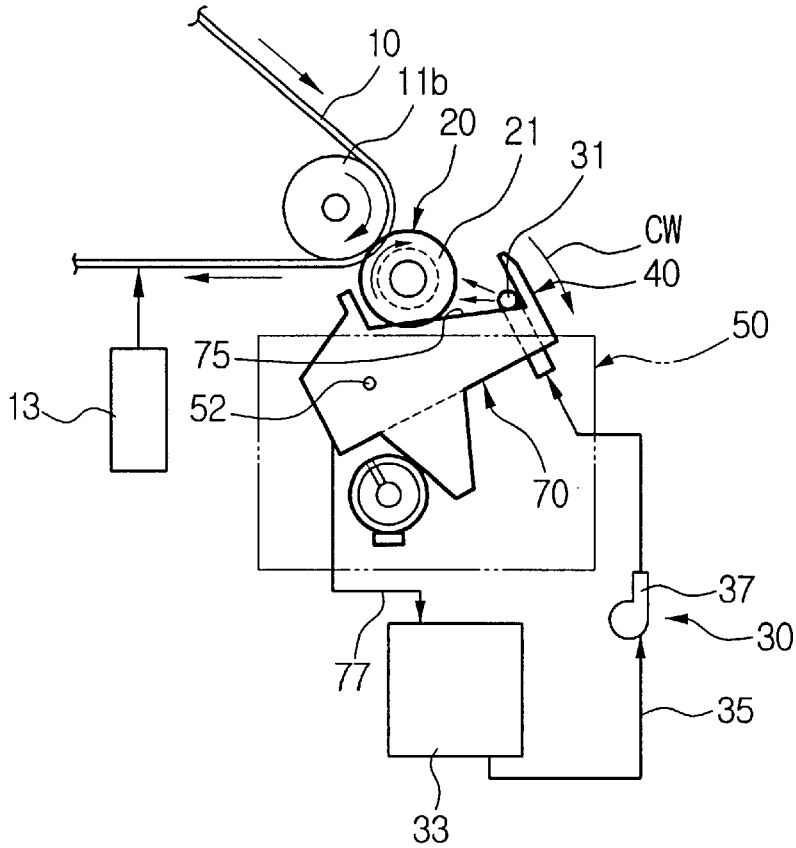
FIG. 3 is a schematic side view showing the photosensitive medium cleaning device of FIG. 2.

Referring to FIGS. 2 and 3, a photosensitive medium cleaning device according to a preferred embodiment of the present invention includes a cleaning roller 20 capable of contacting with a photosensitive belt and separating from the photosensitive belt, that is a photosensitive medium, a NORPAR supplying unit 30 for supplying liquid NORPAR to the cleaning roller 20, and engage and disengage means 40 for contacting the cleaning roller 20 with and separating the cleaning roller 20 from the photosensitive belt 10.

The photosensitive belt 10, which is supported by a supporting roller (not shown), a driving roller (not shown) and a steering roller 11*b*, runs on an endless track.

The cleaning roller 20 eliminates filth such as dust and remaining toner on the surface of the photosensitive belt 10 by rotating in contact with the photosensitive belt 10. The cleaning roller 20 is disposed opposite to the steering roller 11*b* for cleaning the surface of the photosensitive belt 10 before an electrostatic latent image is formed by a projected light from a laser scanning unit 13 on the photosensitive belt 10. The cleaning roller 20 is rotated by a driving motor (60 refer to FIG. 4), which will be described later. In other words, the cleaning roller 20 is rotated in the opposite direction of running of the photosensitive belt 10 and is contacted with the photosensitive belt 10. Moreover, the cleaning roller 20 remains separated from the photosensitive belt 10 when printing is not performed. The cleaning roller 20 has a NORPAR suction layer 21 formed on the outer circumference. The NORPAR suction layer 21 is made of porous material such as sponge. Therefore, the cleaning roller reduces friction while contacting with the photosensitive belt 10, and more effectively eliminates the filth clinging to the surface of the photosensitive belt 10 by cleaning the photosensitive belt 10 containing the NORPAR supplied from the NORPAR supplying unit 30.

The NORPAR supplying unit 30 comprises a discharging nozzle 31 for discharging liquid NORPAR to the cleaning roller 20, a NORPAR tank 33 for storing NORPAR that is supplied to the discharging nozzle 31, and a supplying pump 37 for pumping NORPAR in the NORPAR tank 33 to the discharging nozzle 31 through a supplying passage 35. The discharging nozzle 31 is disposed opposite to the cleaning roller 20 and has a plurality of nozzles for discharging NORPAR. The NORPAR tank 33 is formed at a predetermined place in the printer.

Figure 4A:
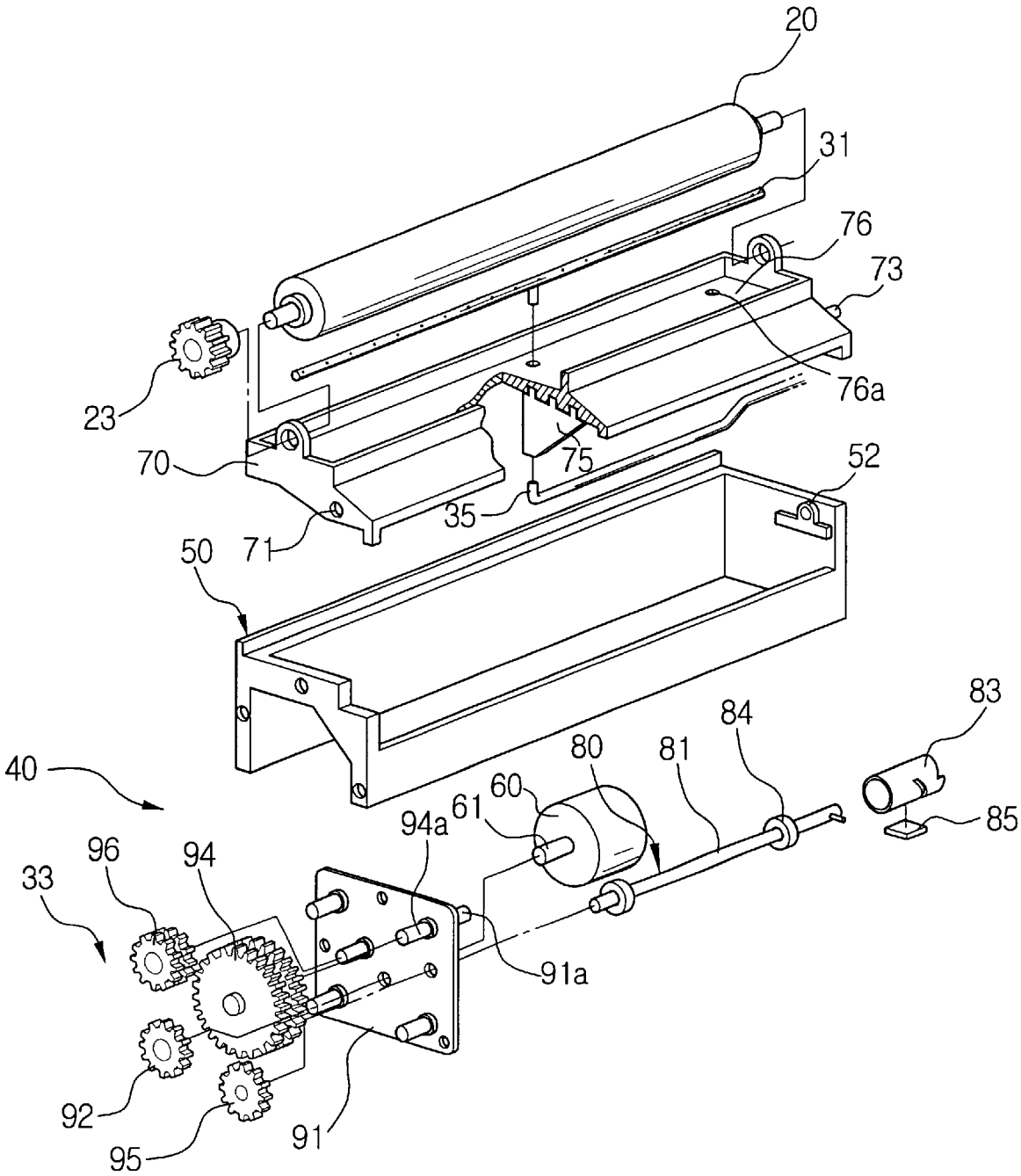
FIG. 4A is an exploded perspective view showing the engage and disengage means of FIG. 2.

Referring to FIG. 4A, the engage and disengage means 40 includes a housing 50 closely disposed to the photosensitive belt 10, a driving motor 60 disposed at the housing 50, a rotating bracket 70 rotatably disposed at the housing 50, and a cam unit 80.

The housing 50 is fixed in the printer, and preferably disposed at the right side of the photosensitive belt 10, which means close to the steering roller 11*b*.

Figure 4B:
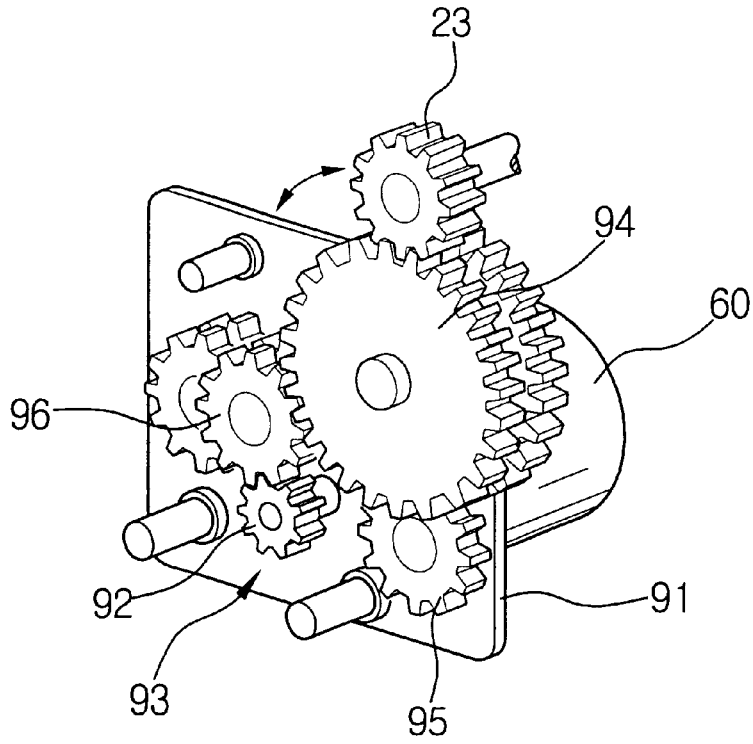
FIG. 4B is a perspective view showing some part of FIG. 4A partially assembled.

The driving motor 60 is a rotating motor capable of rotating in both directions. The driving motor 60 rotates the cleaning roller 20 contacted with the photosensitive belt 10, and supplies power to the cam unit 80 so that the cleaning roller 20 can contact with the photosensitive belt 10 and separate from the photosensitive belt 10. As shown in FIG. 4B, the driving motor 60 is disposed at one side of the housing 50 and supported by a supporting frame 91. A plurality of gear trains 93, contacted with the driving motor 60, is formed in the supporting frame 91. The gear train 93 includes a first gear 94 engaged with the passive gear 23 disposed at the end of the cleaning roller 20, a second gear 95 engaged with the first gear 94 for transferring power to the cam unit 80, a driving gear 92 engaged with a driving shaft 61 of the driving motor 60, and a third gear 96 connecting the driving gear 92 with the first gear 94.

The rotating bracket 70 rotatably supports both ends of the cleaning roller 20. Moreover, a hinge hole 71 for receiving a hinge 91*a* formed at the supporting frame 91 is formed at one end of the rotating bracket 70, and a hinge pin 73 formed at the other end and connected with a hinge bracket 52 disposed at the housing, for selectively contacting the cleaning roller 20 with and separating the cleaning roller 20 from the photosensitive belt 10. The hinge 91*a* is formed on the same axis as a supporting shaft 94*a* of the first gear 94. Thus, the first gear 94 and the rotating bracket 70 have the same center of gyration. In addition, it is preferable that the center of gyration of the rotating bracket 70, in other words, the hinge 91*a* is formed at an eccentric place from the center of mass of the rotating bracket 70. Since the rotating bracket 70, having an eccentric center of gyration, can rotate in the eccentric direction by its own weight, the cleaning roller 20 can maintain being separated from the photosensitive belt 10 when the rotating bracket 70 does not receive a force from the outside. Thus, to contact the cleaning roller 20 with the photosensitive belt 10, a pressure should be added to the rotating bracket 70 with a predetermined force that can overcome the eccentric weight of the rotating bracket 70. Moreover, the discharging nozzle 31 and an accommodating unit 76 storing some of the NORPAR that flows from the cleaning roller 20 and is discharged from the discharging nozzle 31, are formed at the rotating bracket 70. The bottom of the accommodating unit 76, formed diagonally to one side, has a discharging hole 76*a* for discharging NORPAR. Therefore, the NORPAR, returned to the accommodating unit 76, can be circulated to the NORPAR tank 33 through a predetermined salvage passage (77 refer to FIG. 3) and the discharging hole 76*a*.

The cam unit 80 includes a driving shaft 81 rotatably disposed at the housing 50, a cylinder pipe 83 movably supported by the driving shaft 81, a power transferring unit, and a guide unit.

The driving shaft 81 is rotatably disposed at the supporting frame 91 and one end of the driving shaft 81 is connected with the second gear 95 for rotating.

Figure 5:
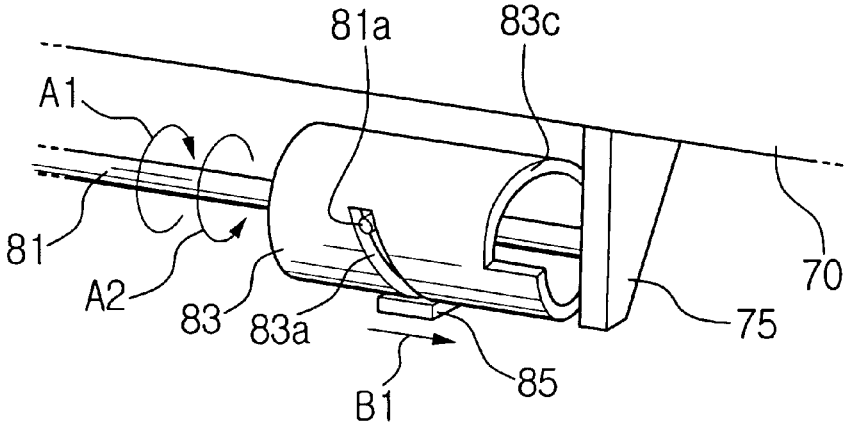
FIGS. 5 through 7 are partial perspective views showing the operation of the cam unit of FIG. 4.
Figure 6:
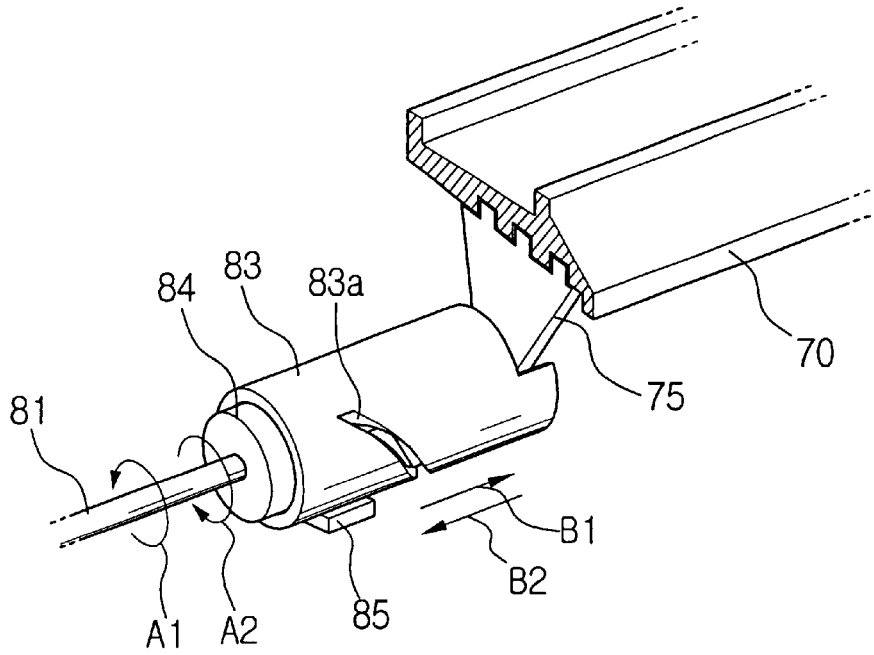

The pipe 83 is supported on the circumference of the driving shaft 81 for rotating and moving linearly thereon. A bushing member 84 is formed between the pipe 83 and the driving shaft 81. The pipe 83 moves straight in one direction in accordance with the rotating direction of the driving shaft 81. That is, as shown in FIG. 5, if the driving shaft 81 rotates in the direction of A1, then the pipe 83 moves straight in the direction of B1 from its initial position and the front end of the pipe 83 contacts with the rotating bracket 70 as shown in FIG. 6. After being contacted with the rotating bracket 70, the pipe 83 continuously rotates in the state of FIG. 7. If the driving shaft 81 rotates in the direction of A2 from the state of FIG. 7, then the pipe 83, contacted with the rotating bracket 70, moves straight in the direction of B2 to the state of FIG. 6 and to its initial position of FIG. 5. In addition, the pipe 83 rotates together with the driving shaft 81 when entirely moved to the extreme end.

The power transferring unit coverts rotation of the driving unit 81 to linear movement of the pipe 83 so that the pipe 83 can move straight and rotate at the extreme end of the direction B1. The power transferring unit includes a guide slit 83*a* formed at the pipe 83, a guide pin 81*a* formed at the driving shaft 81 inserted into the guide slit 83*a*, for relative moving, and a friction member 85 supplying a friction force to the circumference of the pipe 83.

The guide slit 83*a* is formed at the pipe 83 in a spiral fashion for a predetermined length. Moreover, it is preferable that the guide slit 83*a* has an angle of greater than 45 degrees to the driving shaft 81. The greater sloping degree the guide slit 83*a* has, while the driving shaft 81 is rotating, the smaller the friction force that is generated between the guide pin 81*a* and the slide slit 83*a*, which is less than the friction force generated between the friction member 85 and the pipe 83. Thus, the pipe 83 can move straight without being rotated.

Figure 7:
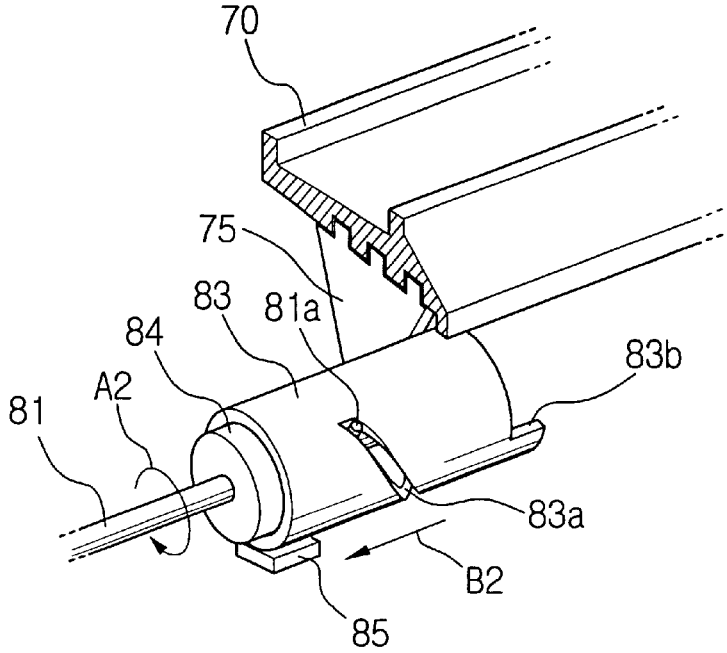

The guide pin 81*a* is fixed at the circumference of the driving unit 81. The guide pin 81*a* guides the pipe 83 to move straight by relatively moving following the guide slit 83*a* while the driving shaft 81 is rotating. As shown in FIG. 7, when the guide pin 81*a* is at one end of the guide slit 83*a*, the guide pin 81*a* rotates the pipe 83 by directly transferring the rotating power of the driving shaft 81 to the pipe 83.

The friction member 85 is disposed at the housing 50 for supplying a predetermined friction force by contacting with the circumference of the pipe 83. As described before, the friction member 85 supplies a greater friction force than a force generated between the guide pin 81*a* and the guide slit 83*a* so that the pipe 83 can move straight without being rotated.

The guide unit guides the pipe 83 to move in the direction of B1 and rotates in the direction of A1 contacting with the rotating bracket 70, which mounts on the circumference of the pipe 83 and rotates. While the pipe 83 is rotating in the direction of A2, the pipe 83 returns to its initial position. The guide unit includes a contacting member 75 protruded from the rotating bracket 70 within the range of linear movement of the pipe 83 and a stopping member 83*b* formed at the front end of the pipe 83. The contacting member 75, pressed by contacting with the pipe 83, is protruded at the lower part of the rotating bracket 70 considering that the pipe 83 is disposed at the lower part of the rotating bracket 70. It is preferable that the contacting member 75 is formed approximately at the center of the rotating bracket 70 so that the contacting member 75 can receive balanced rotating force. The stopping member 83*b* has a sloping side 83*c* formed diagonally on the front end of the pipe 83 and the starting portion and the ending portion of the sloping side 83*c* do not correspond to each other.

Meanwhile, a spring member (not shown) can be formed at the housing 50 for flexibly pressing the rotating bracket 70 in the direction of the cleaning roller 20 which is separated from the photosensitive belt 10. Thus, when the contacting member 75 is separated from the pipe 83, the rotating bracket 70 can promptly return to its initial position by a flexible force of the spring member.

Operation of a photosensitive medium cleaning device of a printer employing the wet method according to the preferred embodiment of the present invention will be described from now on referring to the appended drawings.

Figure 8A:
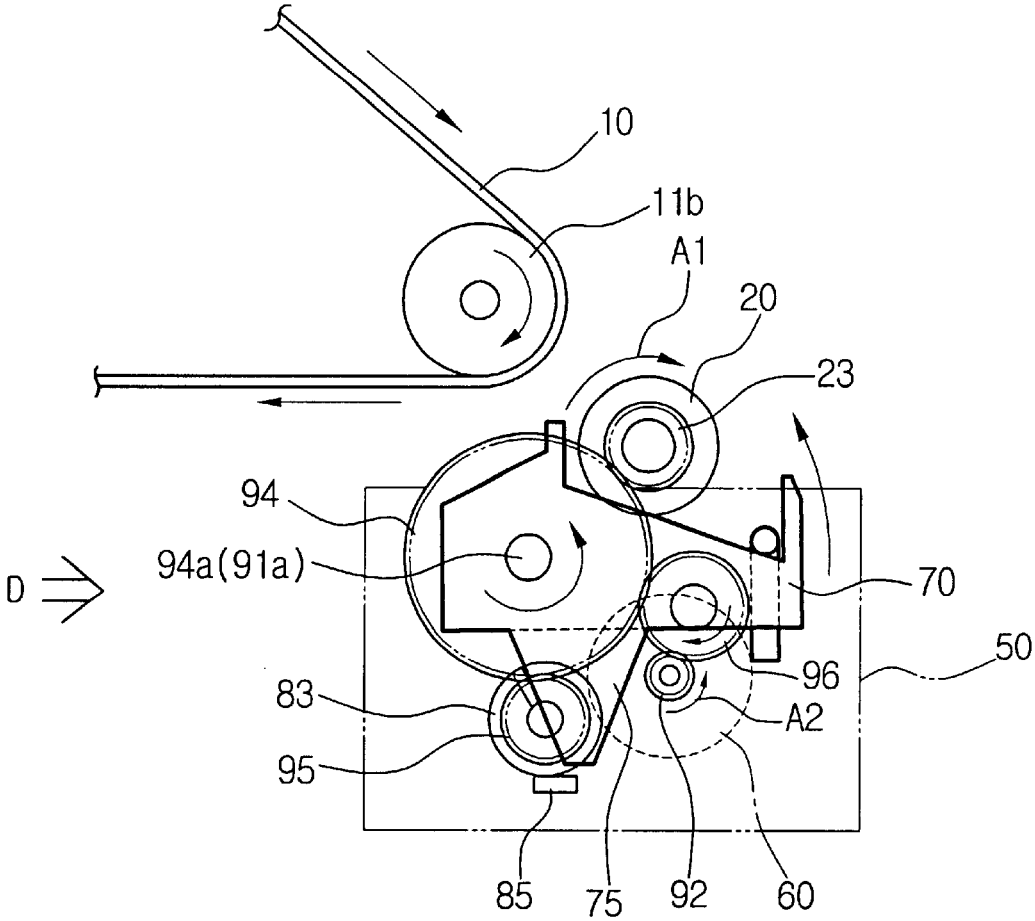
FIGS. 8A through 10B are schematic block diagrams showing the operation of a photosensitive medium cleaning device according to a preferred embodiment of the present invention.
Figure 8B:
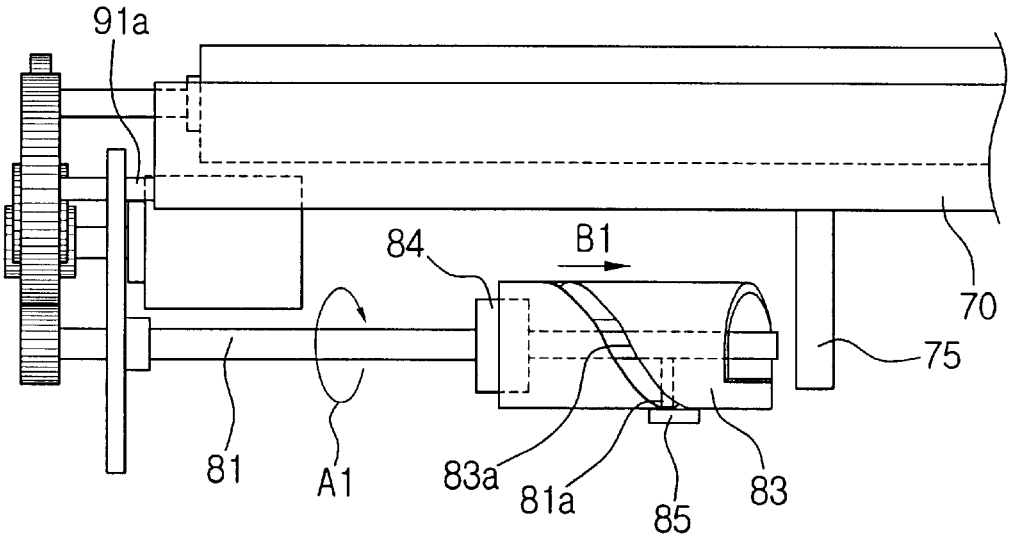

As shown in FIGS. 8A and 8B, when printing is performed with the cleaning roller 20 separated from the photosensitive belt 10, the operation of cleaning roller 20 being contacted with the photosensitive belt 10 will be described. In FIG. 8A, if the driving gear 92 is rotated in the direction of A2 by driving the driving motor 60, the third gear 96, contacted with the driving gear 92, is rotated in the direction of A2. Then, the second gear 95, contacted with the first gear 94, is rotated in the direction of A1. Consequently, the driving shaft 81, contacted with the second gear 95, is rotated in the direction of A1. FIG. 8B is a view taken a view from D of FIG. 8A.

Figure 9A:
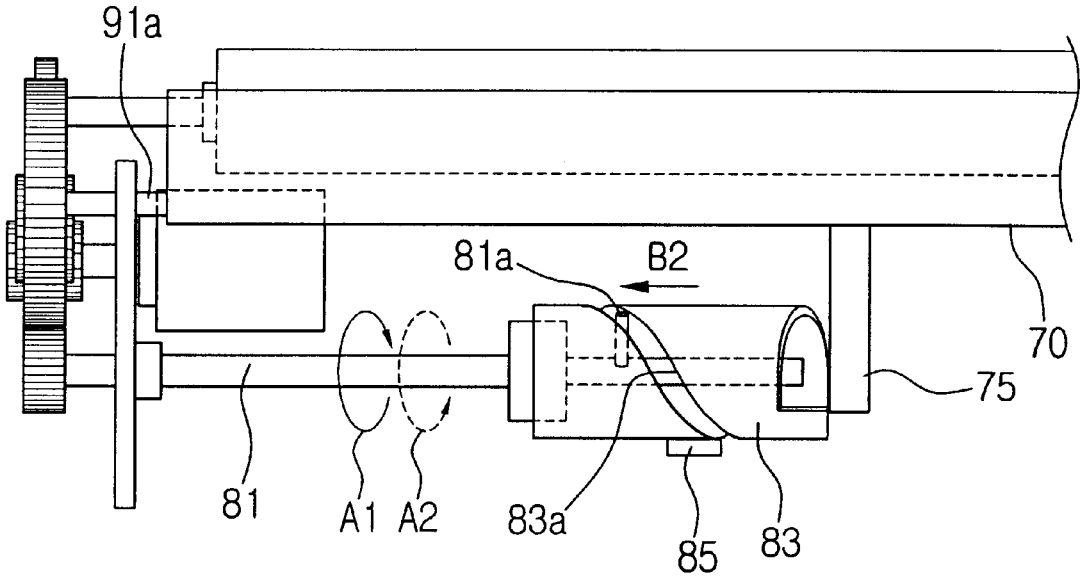

On the other hand, as shown in FIG. 8B, if the driving shaft 81 rotates in the direction of A1, the rotating force is converted to a force in a linear direction by the relative movement of the guide pin 81*a* and the guide slit 83*a* so that the pipe 83 can move straight in the state of FIG. 9A. Then, the front end of the pipe 83 contacts with the contacting member 75 of the rotating bracket 70. In this state, if the driving shaft 81 further rotates in the direction of A1, the pipe 83 receives both of the rotating force and linear force, then the sloping side 83*c* contacts with the contacting member 75 and slides so that the pipe 83 can rotate and move straight. The pipe 83 rotates and linearly moves to the state of FIG. 9B, and the contacting member 75 is stopped by the stopping member 83*b*.

Figure 9B:
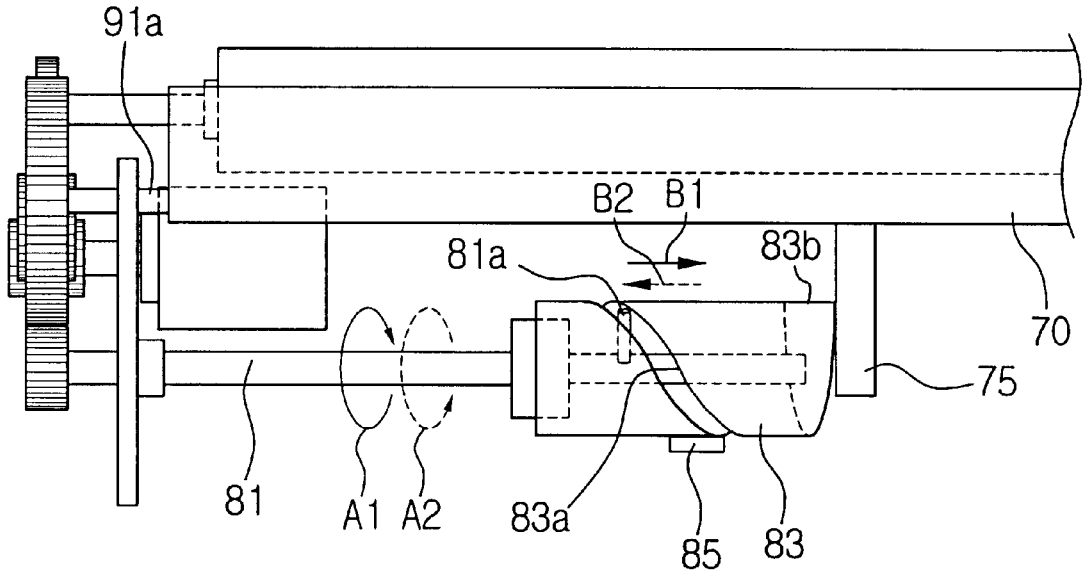
Figure 10A:
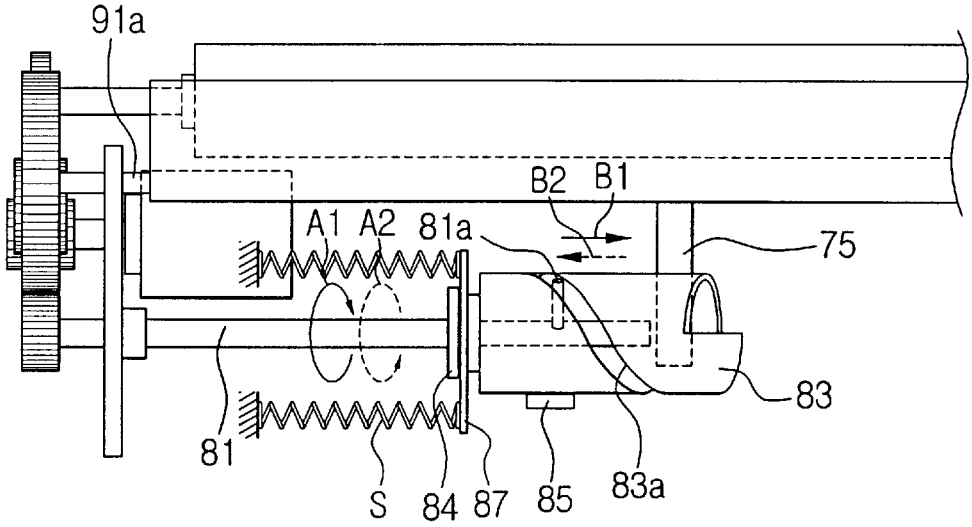
Figure 10B:
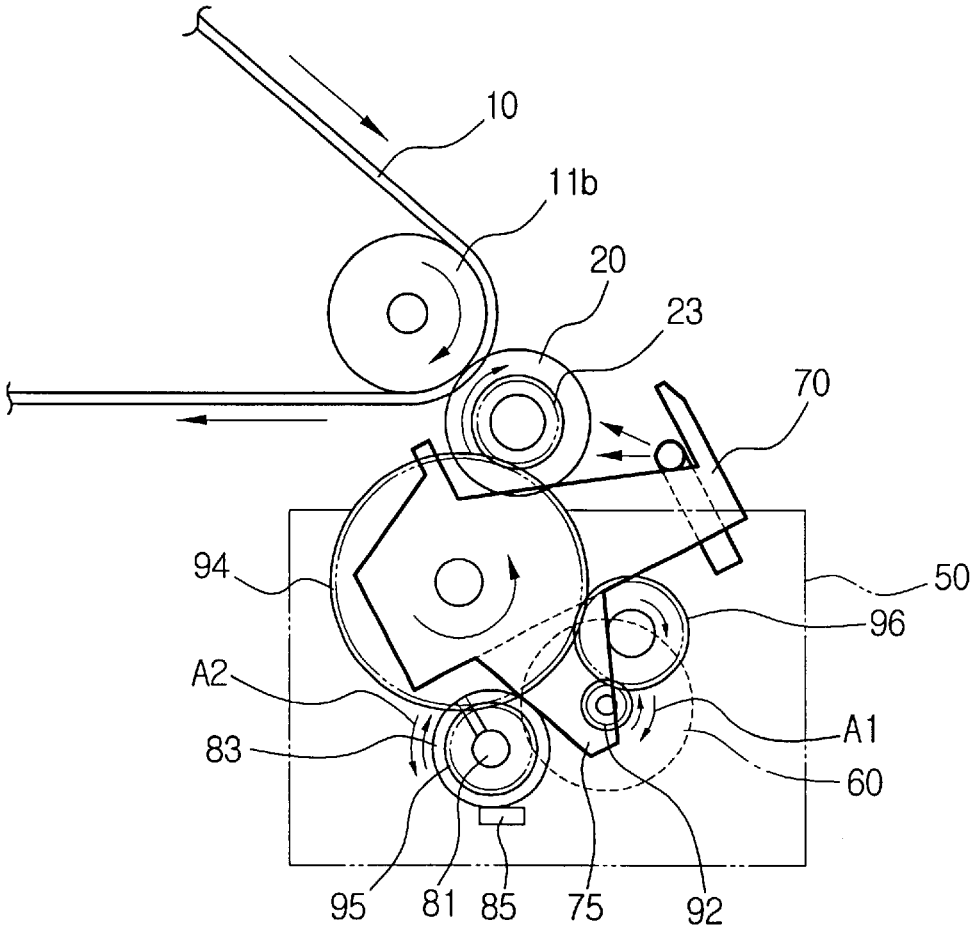

If the driving shaft 81 continues rotating in the state of FIG. 9B, the pipe 83 is rotated by the friction member 85 and the contacting member 75 is stopped by the stopping member 83*b*. At this time, since the force of the contacting member 75 is greater than the linear force of the pipe 83 by the friction member 85, the guide pin 81*a* slides a little bit along the guide slit 83, thus, the stopping member 83*b* moves with the slid length of the guide pin 81*a* to the direction of the contacting member 75. If the guide pin 81*a* contacts with the left end of the guide slit 83*a*, the pipe 83 stops linear movement and only rotates by the rotate force transferred from the driving shaft 81. Therefore, the stopping member 83*b* pushes the contacting member 75 away to one side, and the pushed away contacting member 75 contacts with the circumference of the pipe 83 and slides. As shown in FIG. 10A, if the contacting member 75 starts to mount on the circumference of the pipe 83, the pipe 83 moves straight in the direction of B1 by being rotated so that the contacting member 75 can pass by the sloping side 83*c*. After that, as shown in FIG. 10B, the contacting member 75 completely mounts on the circumference of the pipe 83, and the rotating bracket 70 moves in the direction of the photosensitive belt 10. In addition, when the rotating bracket 70 is rotated in the direction of the photosensitive belt 10, the passive gear 23 is rotated and moved in mesh with the first gear 94. After the passive gear 23 completely stops its movement, the cleaning roller 20 contacts with the photosensitive belt 10 and eliminates the remaining filth on the photosensitive belt 10 by rotating. In this state, as shown in FIG. 3, if NORPAR is supplied from the discharging nozzle 31 to the cleaning roller 20 for wetting the cleaning roller 20, the NORPAR contained in the cleaning roller 20 swells the filth clung on the photosensitive belt 10. Accordingly, the filth can be cleaned more effectively.

Meanwhile, after performing the cleaning in the above state, if printing is stopped, the cleaning roller 20 should be separated from the photosensitive belt 10. To separate the cleaning roller 20 from the photosensitive belt 10, it can be done by reversing the actions for contacting the cleaning roller 20 with the photosensitive belt 10.

That is, in the state of FIG. 10B, if the driving motor 60 is rotated in the direction of A1, the driving shaft 81 is rotated in the direction of A2 as shown in FIG. 10A. Then, the pipe 83 moves straight in the direction of B2 by the relative movement of the guide pin 81*a* and the guide slit 83*a* and at the same time the pipe 83 rotates in the direction of A2. By doing so, the pipe enters the state of FIG. 9B and then the state of FIG. 9A. After that, the rotating bracket 70 returns to its initial position of the state of FIG. 8A, and the cleaning roller 20 is separated from the photosensitive belt 10. In the state of FIG. 9A, if the driving shaft is further rotated in the direction of A2, the pipe 83 moves straight in the direction of B2 and returns to its initial position of FIG. 8A. As described above, by using single driving motor 60, the cleaning roller 20 can contact with the photosensitive belt 10, rotates during printing, and is separate from the photosensitive belt 10 while printing is not performed. Thus, the photosensitive belt 10 can be prevented from being damaged by being swollen due to long contact with the cleaning roller 20, and the life span of the photosensitive belt 10 can be extended and the printing result can be upgraded also.

For the preferred embodiment of the present invention, it has been exemplified that the pipe 83 only moves straight or performs both straight movement and rotation by the relative action of the friction forces between the pipe 83 and the friction member 85 and between the guide pin 81*a* and the guide slit 83*a*. However, as shown in FIG. 10A with imaginary lines, without the reverse rotating of the driving motor 60, the cleaning roller 20 can be separated from the photosensitive belt 10.

In other words, a spring S is formed for pressing the pipe 83 to the left side of the driving shaft 81, that is the direction of B2, when the driving shaft 81 stops rotating. One end of the spring S is connected to a bracket 87 rotatably disposed at the bushing member 84 integrally formed with the driving shaft 81. Moreover, the other end of the spring S can be fixed to the housing 50. The force of the spring is designed not to affect certain movement: movement of the pipe 83 in the right shaft direction, that is the direction of B1 by the rotating of the driving shaft 81, and sliding of the contacting member 75 after being pushed away and contacting with the circumference of the pipe 83.

The condition of the force of the spring for moving the pipe 83 in the right shaft direction is represented by the following mathematical expression 1:

$$Fs<(Fc\times\mu cr)+(Fc\times\mu)+(Wo\times\mu wo) \quad (1)$$

Moreover, the spring force for the pipe 83 to move to the left shaft direction, that is the direction of B2 is as the following mathematical expression 2:

$$Fs>(Fc\times\mu cl)+(Fc\times\mu)+(Wo\times\mu wo) \quad (2)$$

In the above mathematical expressions 1 and 2, Fc is a right shaft direction moving force of the pipe 83, $\mu$cr is a friction count between the guide pin 81*a* and the guide slit 83*a* for the pipe 83 moving in the right shaft direction, that is B2, while the driving shaft 81 is rotating, and $\mu$ is a friction count generated between the pipe 83 and the friction member 85.

In addition, Wo is a lifting power needed for lifting the rotating bracket 70 including the contacting member 75, $\mu$wo is a friction count between the contacting member 75 and the circumference of the pipe 83, and $\mu$cl is a friction count between the guide pin 81*a* and the guide slit 83*a* for the pipe 83 moving in the left shaft direction when the driving shaft 81 stops.

If it is designed to satisfy the above expressions 1 and 2 in accordance with the present invention, when the cleaning roller 20 is separated from the photosensitive belt 10, the pipe 83 can return to its initial position using the spring force Fs without requiring any special power for driving. Therefore, when the pipe 83 returns to its initial position by the spring force Fs, the rotating bracket 70 is rotated by its own weight and the cleaning roller 20 is separated from the photosensitive belt 10.

According to the engage and disengage means and photosensitive medium cleaning device of a printer employing the wet method using the same according to the present invention, the cleaning roller 20 can be contacted with and separated from the photosensitive belt 10 by using a single power for driving, and the cleaning roller 20 contacted with the photosensitive belt 10 can rotate.

Therefore, the photosensitive belt 10 can be effectively cleaned when printing is not performed, as well as preventing the photosensitive belt 10 from being swollen by NORPAR contained in the cleaning roller and being damaged.

Although the preferred embodiments of the present invention have been described, it will be understood by those skilled in the art that the present invention should not be limited to the described preferred embodiments, but various changes and modifications can be made within the spirit and scope of the present invention as defined by the appended claims.

What is claimed is:

1. An engage and disengage apparatus for engaging and disengaging an object in one direction, comprising;

a housing;

a driving motor disposed at the housing;

a rotating bracket, rotatably disposed at the housing, for supporting the object;

a cam unit, operative to rotate and move linearly by a rotating force of the driving motor, for transferring the rotating bracket to one side by being rotated after being moved linearly to the rotating bracket while the driving unit is rotating in one direction, the cam unit being separated from the rotating bracket and enabling the rotating bracket to return to an initial position while the driving motor is rotating reversely.

2. The engage and disengage apparatus of claim 1, wherein the cam unit comprises:

a driving shaft disposed at the housing and rotated by the driving motor;

a cylindric pipe disposed at the circumference of the driving shaft for rotating and moving linearly for a predetermined length, the cylindric pipe moving linearly to one direction from an initial position with a front end thereof contacting with and separating from the rotating bracket;

a power transferring unit that transforms a rotary motion of the driving shaft to a linear motion of the cylindric pipe so as to move the cylindric pipe in a linear direction, and when the pipe is contacted with the rotating bracket, the power transferring unit transfers a rotating force directly to the cylindric pipe for rotating the cylindric pipe; and a guide unit that guides the rotating bracket to mount on the circumference of the cylindric pipe and rotates, while the cylindric pipe is rotating in one direction in contact with the rotating bracket, and guides the rotating bracket to return from the circumference of the cylindric pipe and be placed at the initial position, while the cylindric pipe is rotating reversely.

3. The engage and disengage apparatus of claim 2, wherein the power transferring unit includes:

a spiral guide slit formed at the cylindric pipe for a predetermined length;

a guide pin secured to the circumference of the driving shaft for guiding the movement of the cylindric pipe, in a manner of being relatively moved along the spiral guide slit while the driving unit is rotating; and a friction member that supplies a friction force to the cylindric pipe and prevents the cylindric pipe from being rotated by the rotating power of the driving shaft, so that the cylindric pipe can move linearly by the relative movement of the guide pin and the spiral guide slit.

4. A photosensitive medium cleaning apparatus of a printer employing a wet method, comprising:

a cleaning roller for eliminating filth on the surface of the photosensitive medium by rotating in contact with the photosensitive medium;

a liquid toner supplying unit for supplying liquid toner to the cleaning roller; and an engage and disengage apparatus which rotatably supports the cleaning roller, and contacts the cleaning roller with the photosensitive medium and separates the cleaning roller from the photosensitive medium;

wherein the engage and disengage apparatus comprises:

a housing closely secured to the photosensitive medium;

a driving motor disposed at the housing for rotating a cleaning roller contacted with the photosensitive medium;

a rotating bracket rotatably disposed at the housing for rotatably supporting the cleaning roller and contacting the cleaning roller with the photosensitive medium and separating the cleaning roller from the photosensitive medium; and a cam unit, rotating and moving linearly by a rotating force of the driving motor, that moves the rotating bracket for the cleaning roller to be contacted with the photosensitive medium by being rotated after being moved to the rotating bracket, while the driving motor is rotating in one direction, and returns the rotating bracket to its initial position by being separated from the rotating bracket, while the rotating motor is rotating in the opposite direction.

5. The photosensitive medium cleaning apparatus of claim 4, wherein the cam unit comprises:

a driving shaft disposed at the housing for rotating by the driving motor;

a cylindric pipe disposed at the circumference of the driving shaft for rotating and moving straight, and while the cylindric pipe is moving linearly in one direction from the initial position, the front end of the pipe contacts with the rotating bracket;

a power transferring unit for transferring the rotation of the driving shaft into straight movement of the cylindric pipe so that the cylindric pipe can move straight in one direction, and when the cylindric pipe is contacted with the rotating bracket, transfers the rotating force to the cylindric pipe; and a guide unit for guiding the rotating bracket to mount on the circumference of the cylindric pipe when the cylindric pipe is contacted with the rotating bracket and rotates in one direction, and guiding the rotating bracket to return from the circumference of the cylindric pipe while the cylindric pipe is rotating reversely.

6. The photosensitive medium cleaning apparatus of claim 5, wherein the power transferring unit comprises:

a spiral guide slit formed at the cylindric pipe for a predetermined length;

a guide pin secured to the circumference of the driving shaft for guiding movement of the cylindric pipe, in a manner of being relatively moved along the spiral guide slit while the driving unit is rotating; and a friction member that supplies the friction force to the cylindric pipe and prevents the cylindric pipe from being rotated by rotating power of the driving shaft, so that the cylindric pipe can move linearly by the relative movement of the guide pin and the spiral guide slit.

7. The photosensitive medium cleaning apparatus of claim 6, wherein the spiral guide slit is formed diagonally at an angle of more than 45 degrees with the driving shaft, and guides the guide pin to relatively slide along the spiral guide slit by a force less than the friction force of the friction member.

8. The photosensitive medium cleaning apparatus of claim 5, further comprising a spring member for flexibly pressing the cylindric pipe in the direction of separating from the rotating bracket.

9. The photosensitive medium cleaning apparatus of claim 5, herein the guide unit comprises:

a contacting member protruding from the rotating bracket to the range of linear movement of the cylindric pipe; and a stopping member formed at spiraling on one end side of the cylindric pipe that is sloping at a predetermined angle along a circumferential direction of the cylindric pipe, wherein while the cylindric pipe is rotating after being moved to the contacting member, the contacting member moves along the sloping side, stopped by the stopping member, and mounts on the circumference of the cylindric pipe, containing the cleaning roller with the photosensitive medium.

10. The photosensitive medium cleaning apparatus of claim 5, further comprising a spring for supplying a flexible force for the cylindric pipe to return the cylindric pipe to the initial position when the driving shaft stops, wherein the rotating bracket, disposed eccentrically from a rotating center, being rotated by its own weight so that the cleaning roller can be separated from the photosensitive medium when the cleaning roller, contacted with the photosensitive medium, is separated from the cylindric pipe.

11. The photosensitive medium cleaning apparatus of claim 4, further comprising a spring member for flexibly pressing the rotating bracket in the direction where the cleaning roller is separated from the photosensitive medium.

12. The photosensitive medium cleaning apparatus of claim 4, wherein the liquid toner supplying unit comprises:

a discharging nozzle disposed at the rotating bracket opposite to the cleaning roller in a lengthwise direction, the discharging nozzle having a pluarlity of nozzles for discharging liquid toner therethrough;

a liquid toner tank for storing liquid toner and supplying the liquid toner to the discharging nozzle; and a supplying pump for pumping the liquid toner in the liquid toner tank to the discharging nozzle through a supplying passage.

13. The photosensitive medium cleaning apparatus of claim 4, wherein the cleaning roller is disposed at a predetermined place for being contacted with the photosensitive medium before an electrostatic latent image is formed on the photosensitive medium by a light projected from a laser projecting unit.

* * * * *